United States Patent [19]

Inagaki et al.

[11] 4,434,355

[45] Feb. 28, 1984

[54] OFFSET PREVENTION LAYER FOR HEAT ROLLER FIXING DEVICE

[75] Inventors: Sanji Inagaki; Shinji Takiguchi, both of Toyokawa; Susumu Tanaka, Hoi, all of Japan

[73] Assignee: Minolta Camera Kabushiki Kaisha, Osaka, Japan

[21] Appl. No.: 398,700

[22] Filed: Jul. 15, 1982

[30] Foreign Application Priority Data

Jul. 17, 1981 [JP] Japan ..... 56-112811
May 31, 1982 [JP] Japan ..... 57-93868

[51] Int. Cl.[3] ..... B21B 27/00; H05B 3/02

[52] U.S. Cl. ..... 219/216; 219/469; 432/60; 432/228; 165/133

[58] Field of Search ..... 219/216, 469, 470, 471; 432/227, 228, 60; 250/317.1, 318, 319; 165/89, 133; 355/3 FU; 29/132

[56] References Cited

U.S. PATENT DOCUMENTS 3,291,466 12/1966 Aser ..... 219/216
3,593,398 7/1971 Hess ..... 29/132
3,948,214 4/1976 Thettu ..... 219/216
4,109,024 4/1977 Namiki ..... 219/470
4,179,601 12/1979 Tarumi ..... 219/216
4,257,699 3/1981 Lentz ..... 219/216
4,272,179 6/1981 Seanor ..... 219/216

FOREIGN PATENT DOCUMENTS 55-17182 of 1980 Japan .
57-54968 of 1982 Japan .

*Primary Examiner*—B. A. Reynolds
*Assistant Examiner*—Teresa J. Walberg
*Attorney, Agent, or Firm*—Wenderoth, Lind & Ponack

[57] ABSTRACT

The disclosure is directed to a heat roller fixing device for use in an electrophotographic copying apparatus and the like, which includes a heating roller constituted by laminating an offset prevention layer on an electrically conductive core member and having a heating element incorporated in it so as to be driven for rotation by a driving unit, and a pressure roller constituted by forming an electrically insulative layer on another electrically conductive core member and held in contact under pressure with the heating roller for simultaneous rotation with the heating roller, so as to fix toner image formed on copy paper onto the copy paper by causing the copy paper carrying the toner image on it, to pass between the heating roller and pressure roller. The offset prevention layer is composed of fluorine resin containing carbon fibers in a combined amount of less than 30%.

7 Claims, 11 Drawing Figures

*Fig. 2*

| Experiment No | PFA additive. (CF)n add. amount (wt%) | KURECA M-107T add. amount (wt%) | Check point paper pass. time (min) | Offset property with respect to positively charged toner | Check point paper pass. time (min) | Offset property with respect to negatively charged toner |
|---|---|---|---|---|---|---|
| | | | | Fixing temp. (°C) 140°C 160 180 200 (°C) | | Fixing temp. (°C) 140°C 160 180 200 (°C) |
| 1 | 0 | 0 | 5 | | 60 | |
| 2 | 0 | 7 | 5 | | 60 | |
| 3 | 0 | 11 | 5 | | 60 | |
| 4 | 0 | 13 | 5 | | 30 | |
| 5 | 0 | 25 | 5 | | 20 | |
| 6 | 1 | 11 | 5 | | 60 | |
| 7 | 1 | 12 | 5 | | 20 | |
| 8 | 1 | 13 | 5 | | 20 | |
| 9 | 1 | 25 | 5 | | 20 | |
| 10 | 1 | 30 | 5 | | 20 | |
| 11 | 5 | 7 | 5 | | 60 | |
| 12 | 5 | 9 | 5 | | 60 | |
| 13 | 5 | 10 | 5 | | 60 | |
| 14 | 5 | 11 | 5 | | 60 | |
| 15 | 5 | 12 | 5 | | 30 | |
| 16 | 5 | 13 | 5 | | 20 | |
| 17 | 5 | 15 | 5 | | 60 | |
| 18 | 5 | 20 | 5 | | 20 | |
| 19 | 5 | 25 | 5 | | 20 | |
| 20 | 5 | 30 | 5 | | 20 | |
| 21 | 15 | 5 | 5 | | 60 | |
| 22 | 15 | 11 | 5 | | 60 | |
| 23 | 15 | 12 | 5 | | 30 | |
| 24 | 15 | 13 | 5 | | 20 | |
| 25 | 15 | 15 | 5 | | 20 | |
| 26 | 15 | 20 | 5 | | 20 | |

Fig. 11

| Experiment No. | PFA additive: (CF)n add. amount (wt %) | PFA additive: PYROFIL NR7003 add. amount (wt %) | Offset property with respect to positively charged toner: Check point paper pass. time (min.) | Offset property with respect to positively charged toner: Fixing temp. (°C) | Offset property with respect to negatively charged toner: Check point paper pass. time (min.) | Offset property with respect to negatively charged toner: Fixing temp. (C°) |
|---|---|---|---|---|---|---|
| 27 | 5 | 9 | 5 | | 60 | |
| 28 | 5 | 11 | 5 | | 60 | |
| 29 | 5 | 13 | 5 | | 20 | |
| 30 | 5 | 25 | 5 | | 20 | |
| Comp. data carbon black 25 wt % | | | 5 | | 20 | |

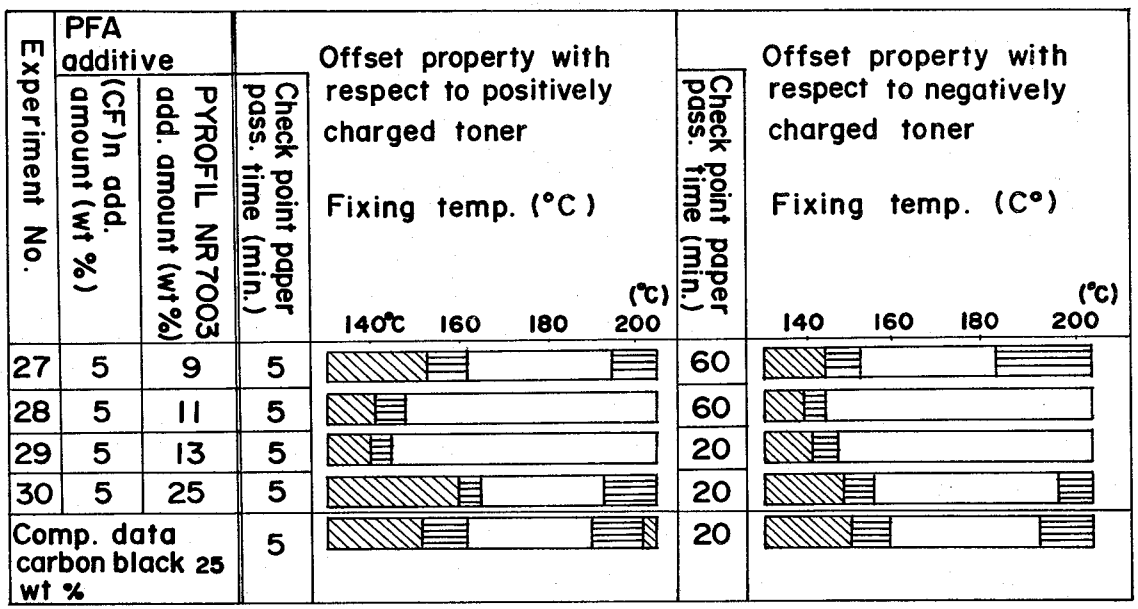

OFFSET PREVENTION LAYER FOR HEAT ROLLER FIXING DEVICE

BACKGROUND OF THE INVENTION

The present invention generally relates to a heat roller fixing arrangement for use in an electrophotographic copying apparatus, and more particularly, to a heat roller fixing device which includes a heating roller formed by laminating an offset prevention layer on an electrically conductive core member, and a pressure roller constituted by forming an electrically insulative layer on another electrically conductive core member for passing between said heating roller and pressure roller a copy paper sheet which carries a toner image formed thereon by the known electrophotographic method so as to fix the toner image onto the copy paper sheet, and especially, to a heat roller fixing device of a type having no offset prevention agent on the surface of the heating roller.

The heat roller fixing device of the above described type has such advantages that copy material, for example in the form of a copy paper sheet is provided with a good feel to the hand of the user after the fixing and which does not soil the hand of the user with an offset prevent agent, and that, since no means is required for applying the offset prevention agent, the fixing device may be simplified in its construction, with a consequent reduction in cost, etc., as compared with heat roller fixing devices which employ the offset prevention agent. On the contrary, however, the heat roller fixing device of the above described type which does not employing the offset prevention agent has a drawback in that the undesirable offset phenomenon tends to take place very easily. Conventionally, various means have been proposed for preventing the offset phenomenon, for example, by employing a heating roller coated with a fluorine resin layer having superior release properties and heat resistance, as an offset prevention layer for the improvement of releasing between the heating roller and toner, or by proper selection of binder resins for the toner or addition of release agents such as low-molecular weight polypropylene and the like for the improvement of release properties of the toner itself. However, in the known fixing devices of the above described type, it has still been difficult to completely prevent the offset phenomenon unless the offset prevention agent is employed.

Moreover, in the heating roller laminated with the fluorine resin as an offset prevention layer, there is a problem that the surface thereof is abraded or damaged by the contact with copy paper sheets, a copy paper separating claw, a temperature control element or the like. Particularly, in the case where the offset prevention layer is made thin for better heat conduction, the core member or core metal of the heating roller may undesirably be exposed, with an extreme reduction in the release properties, thus giving rise to the offset phenomenon. Accordingly, the offset prevention layer is required to have a thickness in the range of 30 to 40$\mu$, but in this case, heat conduction is reduced, with a consequent reduction in stability of temperature on the heat roller surface.

Although there have conventionally been proposed some heating rollers in which pigments are mixed in the fluorine resin, or fluorine resin powder is blended into a binder having favorable abrasion resistance, these known heat rollers still have drawbacks in that the release properties thereof as fixing rollers are inferior, with a tendency to produce the undesirable offset phenomenon.

SUMMARY OF THE INVENTION

Accordingly, an essential object of the present invention is to provide a heat roller fixing device which is provided with a heating roller laminated with a fluorine resin having good release properties and heat resistance, and which is superior in offset prevention effect, abrasion resistance, and heat conductivity.

Another important object of the present invention is to provide a heat roller fixing device of the above described type which is simple in construction and stable in functioning with high reliability and durability, and can be readily incorporated into electrophotographic copying apparatuses and the like at low cost.

In accomplishing these and other object, according to one preferred embodiment of the present invention, there is provided a heat roller fixing device which includes a heating roller formed by laminating an offset prevention layer on an electrically conductive core member, and a pressure roller held in pressure contact with said heating roller and constituted by forming an electrically insulative layer on another electrically conductive core member for passing between said heating roller and pressure roller a copy paper sheet which carries a toner image formed thereon so as to fix the toner image onto the copy paper sheet, and in which said offset prevention layer is composed of a fluorine resin containing carbon fibers in an amount of 9 to 25% by weight and more preferably, 12 to 20% by weight, or a fluorine resin further containing polycarbon monofluoride and the amount of polycarbon monofluoride and carbon fibers together is less than 30% by weight and more preferably, less than 28% added.

By the arrangement according to the present invention as described above, an improved heating roller fixing device equipped with a heating roller having favorable release properties and heat resistance, and superior in offset prevention effect, abrasion resistance and heat conductivity, has been advantageously provided, with substantial elimination of disadvantages inherent in the conventional heat roller fixing devices.

BRIEF DESCRIPTION OF THE DRAWINGS

These and other objects and features of the present invention will become apparent from the following description taken in conjunction with the preferred embodiment thereof with reference to the accompanying drawings, in which;

FIG. 2 is a diagram showing offset properties in EXAMPLE 1 according to the present invention, FIG. 11 is a diagram showing offset properties in EXAMPLE 2 according to the present invention and comparative data therefor.

DETAILED DESCRIPTION OF THE INVENTION

Figure 1:
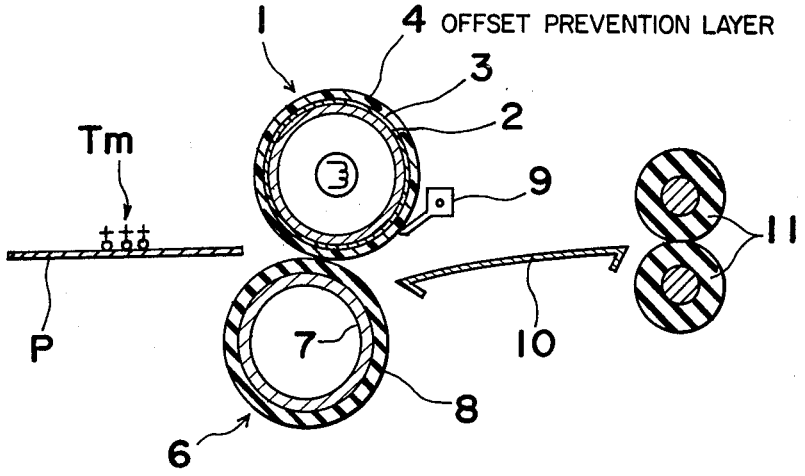
FIG. 1 is a schematic side sectional view of a heat roller fixing device according to one preferred embodiment of the present invention.
Figure 5:
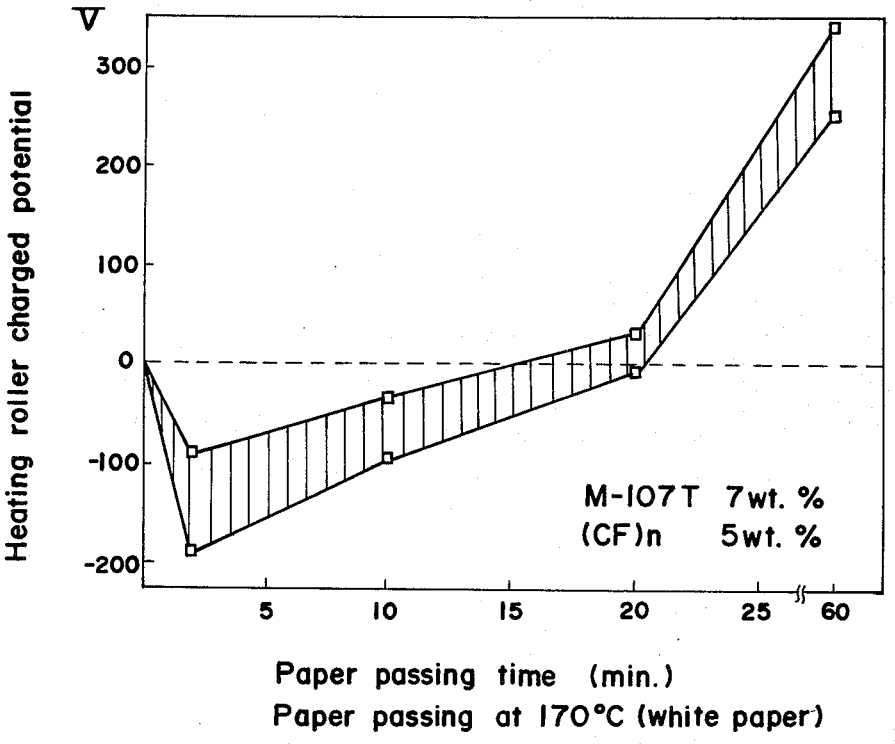
FIGS. 4 through 10 are graphs showing variations of surface potentials in heating rollers for a heat roller fixing device according to the present invention, and variations of surface potentials in the conventional heating rollers.

For achieving the objects as described earlier, the present inventors have ensured through experiments that, in a fixing device which includes a heating roller formed by laminating an offset prevention layer composed of fluorine resin on an electrically conductive core member directly or through a primer layer (bonded layer), for example, by a blast finish, etc., and a pressure roller constituted by forming an electrically insulative layer on another electrically conductive core member, when a copy paper sheet carrying thereon a positively charged toner image is subjected to fixing, the offset phenomenon takes place only at an early stage, and disappears after a certain period of time, while on the other hand, when a copy paper sheet bearing a negatively charged toner image is fixed, the offset phenomenon does not take place at an early stage, but tends to be produced after a certain period of time, and that the above trend is attributable to the fact that both the heating roller and the pressure roller are charged by friction or frictional contact between said heating roller and pressure roller, and also between the respective rollers and copy paper sheets, with the heating roller beginning to be negatively charged at the early stage and, after a certain period of time, to be positively charged, and thus, the offset phenomenon may be attributable to electrostatic attraction of toner.

Therefore, in a heating roller fixing device employing a heating roller laminated with fluorine resin as the offset prevention layer and used without application of an offset prevention agent on the surface of the heating roller, it is necessary for prevention of the undesirable offset phenomenon, that the heating roller not be charged at least until the charged toner is electrostatically attracted thereto or to have the heating roller charged to the same polarity as that of the charged toner, and more preferably, to have said heating roller hardly charged at all.

Moreover, for improving abrasion resistance and heat conductivity simultaneously, it is required that an additive for the offset prevention which may satisfy the above requirements should have superior abrasion resistance and heat conductivity.

With particular attention directed to the above points, the present inventors have found, through various research into the matter, that the requirements as described earlier may be met by addition of carbon fibers in an amount of 9 to 25% by weight and preferably 12 to 20% by weight, to the offset prevention layer composed of fluorine resin, and further that the abrasion resistance as described earlier can be remarkably improved by addition of polycarbon monofluoride in an amount such that the combined amount of polycarbon monofluoride and carbon fibers is less than 30% by weight and more preferably less then 28% by weight, so as to complete the present invention.

More specifically, the heat roller fixing device according to the present invention including a heating roller formed by laminating an offset prevention layer on an electrically conductive core member, and a pressure roller held in pressure contact with said heating roller and constituted by forming an electrically insulative layer on another electrically conductive core member for passing between said heating roller and pressure roller a copy paper sheet which carries a toner image formed thereon so as to fix the toner image onto the copy paper sheet, is characterized in that said offset prevention layer is composed of a fluorine resin containing carbon fibers in an amount of 9 to 25% by weight and more preferably, 12 to 20% by weight, or a fluorine resin further containing polycarbon monofluoride in an amount such that the combined amount of polycarbon monofluoride and carbon fibers is less than 30% by weight and more preferably less than 28% by weight.

As materials for the electrically conductive core members for the heating roller and pressure roller aluminum, aluminum alloys, iron alloys such as stainless steel, and other metals may be employed.

The primer layer may be formed by a heat resisting primer containing fluorine resin, etc. and commercially available as an adhesive priming agent for metallic materials such as iron alloys, aluminum alloys, etc. as described above, and more specifically, for example, by COOKWEAR A PRIMER WHITE 459-882 (name used in trade and manufactured by Du Pont Co., Ltd. Japan), MPG-RD (name used in trade and manufactured by Mitsui Phlorochemical Co., Ltd. Japan), etc.

Meanwhile, the offset prevention layer is mainly composed of fluorine resins having superior release properties and heat resistance such as polytetrafluoro ethylene resin (PTFE) represented by the formula

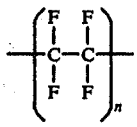

polytetrafluoro ethylene perfluoro alkoxy ethylene copolymer resin (PFA resin) represented by the formula

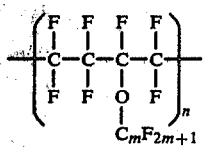

or polytetrafluoro ethylene-propylene hexafluoride copylymer resin i.e. fluorinated ethylene propylene resin (FEP resin) represented by the formula

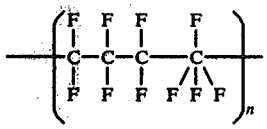

and the like, and contains carbon fibers having superior abrasion resistance, heat conductivity, electrical conductivity and flexibility in said fluorine resin. More specifically, carbon fibers such as KURECA M-107T or KURECA M-201S (name used in trade and manufactured by Kureha Chemical Industry Co., Ltd. Japan), PYROFIL NR7003 or PYROFIL EHMS10STA (name used in trade and manufactured by Mitsubishi Rayon Co., LTD. Japan), TORAYCA T008A or TORAYCA M40 (name used in trade and manufactured by Toray Industries, Inc. Japan) BESFIGHT 1000 or BES- FIGHT HM-6000 (name used in trade and manufactured by TOHO RAYON CO., LTD. Japan), and Carbolon $\phi$ GF-20 or GF-3 (name used in trade and manufactured by NIPPON CARBON CO., LTD. Japan), etc. may be employed.

The carbon fibers as described above are added to the fluorine resin in an amount of 9 to 25% by weight, and more preferably 12 to 20% by weight, because if the amount added is less than 9% by weight, the effect of addition is not sufficient, while on the contrary, when the amount added exceeds 25% by weight, the release properties tend to be reduced.

The fluorine resin for the primer layer as described in the foregoing further contains polycarbon monofluoride represented by the molecular formula $(CF)_n$ which is an inorganic high molecular compound produced by chemical reaction between fluorine and carbon or between fluorine and graphite, and which is superior to carbon fibers in abrasion resistance, with better release properties than in fluorine resin. More specifically, polycarbon monofluoride manufactured by DAIKIN KOGYO CO., LTD. Japan, polycarbon monofluoride manufactured by NIPPON CARBON CO., LTD. Japan, etc. may be employed.

Polycarbon monofluoride as described above is added to the fluorine resin together with carbon fibers, and the combined amount is less than 30% by weight, and more preferably, less than 28% by weight because if the amount added of polycarbon monofluoride exceeds 30% by weight, the effect for abrasion resistance is not noticed, but rather deteriorates.

Meanwhile, the electrically insulative layer for the pressure roller may be formed by normally employed rubber-like elastic material such as natural rubber, synthetic rubber etc.

DESCRIPTION OF THE PREFERRED EMBODIMENT

Referring now to the drawings, there is shown in FIG. 1, the general construction of a heat roller fixing device according to one preferred embodiment of the present invention. In FIG. 1, the heat roller fixing device generally includes a heating roller 1 driven for rotation by a suitable driving means such as an electric motor (not shown), a pressure roller 6 rotatably provided below and in contact with the heating roller 1 for simultaneous rotation therewith, a separating claw 9 positioned to contact the peripheral surface of the heating roller 1 for separation of a copy paper sheet therefrom, a guide plate 10, and a pair of copy paper discharge rollers 11 rotatably provided for discharging the copy paper sheet processed through the rollers 1 and 6 out of the fixing device.

The heating roller 1 further includes a metallic roller 2 as the electrically conductive core member, a primer layer 3 formed on the peripheral surface of the metallic roller 2 by a known method, and an offset prevention layer 4 of a fluorine resin further laminated thereon by coating of fluorine resin containing carbon fibers in an amount of 9 to 25% by weight or further containint polycarbon monofluoride in an amount such that the combined amount of polycarbon monofluoride and carbon fibers is less than 30% by weight, with the metallic roller 2 having therein a heater 5 so as to be rotated by the electric motor. The pressure roller 6 is constituted by forming an electrically insulative layer 8 on the surface of a metallic roller 7 as another core member so as to be held in pressure contact with the heating roller 1 for simultaneous rotation with said heating roller 1. During functioning of the fixing device, the heating roller 1 is heated by the heater 5 up to temperatures set at a suitable temperature in the range of 140° to 210° C. according to the kinds of toner to be employed.

In the above arrangement, when a copy paper sheet P carrying thereon a positively or negatively charged toner image Tm formed by electrophotographic method is supplied between the rollers 1 and 6 so as to be passed therebetween while being held under pressure by said rollers 1 and 6 for fixing the toner image Tm onto the copy paper sheet P, a copied image free from the offset phenomenon can be obtained from the initial stage of the fixing.

Hereinbelow, EXAMPLES are described for the purpose of illustrating the present invention, without any intention of limiting the scope thereof.

EXAMPLE 1

By employing an aluminum roller as the electrically conductive core member, a primer layer of 6 $\mu$m in thickness composed of a primer paint MPG-RD (name used in trade and manufactured by Mitsui Phlorochemical Co., Ltd. Japan referred to earlier) was formed on the surface of said aluminum roller by an ordinary method, while an offset prevention layer was further formed on said primer layer by applying thereonto by baking, a mixture prepared by adding carbon fibers KUREKA K107T referred to earlier (50$\mu$ in length and 7 to 10$\mu$ in diameter) and polycarbon monofluoride (CF)n (name used in trade and manufactured by DAIKIN KOGYO CO., LTD. Japan mentioned earlier) with average particle diameter of 1$\mu$ into PFA resin in powder form respectively at the ratios shown in the composition column of Table 1 given below (Experiment Nos. 1 to 26 in Table 1), and by polishing the resultant offset prevention layer to a thickness of 30 to 40$\mu$ as to produce the heating roller.

Meanwhile, apart from the above, a pressure roller was prepared by covering the surface of an aluminum roller with commercially available silicone rubber, and using the heating roller and pressure roller prepared as described above, the heat roller fixing device as shown in FIG. 1 was constituted. By using the fixing device thus prepared, fixing processing was effected on copy paper sheets bearing thereon positively charged toner images (in which the toner was mainly composed of styrene acrylic resin, with an average particle diameter of 14$\mu$ and charge in the range of 10 to 12 $\mu$c/g), and also on copy paper sheets bearing thereon negatively charged toner images (in which the toner was mainly composed of stylene acrylic resin, with an average particle diameter of 14$\mu$ and charge in the range of 8 to 10 $\mu$c/g) repectively at a heating roller temperature of 170° C., and at a rate of twelve sheets per minute, and then, the offset properties were examined after continuous copy paper passing for five minutes with respect to the positively charged toner images, and after continuous copy paper passing for twenty minutes, thirty minutes or sixty minutes with respect to the negatively charged toner images, the results of which examination are given in a diagram of FIG. 2.

TABLE 1

| Experiment No. | PFA additive: CFn add. amount (wt %) | PFA additive: KURECA M-107T add. (wt %) | charging characteristics | Electrical resistance (Ω · cm) | Offset preperty: + toner | Offset preperty: − toner | Abrasion mass (mg/1500 times) | Overall evaluation: + toner | Overall evaluation: − toner |
|---|---|---|---|---|---|---|---|---|---|
| 1 | 0 | 0 | D | higher than $10^{15}$ | X | X | 13 | X | X |
| 2 | 0 | 7 | D | higher than $10^{15}$ | X | X | 11 | X | X |
| 3 | 0 | 11 | B | $6 \times 10^{12}$ | ◎ | O | 11 | O | O |
| 4 | 0 | 13 | A | $9 \times 10^{10}$ | ◎ | ◎ | 10.5 | O | O |
| 5 | 0 | 25 | A | $2 \times 10^{4}$ | O | O | 9.5 | O | O |
| 6 | 1 | 11 | B | $7 \times 10^{12}$ | ◎ | O | 9.5 | O | O |
| 7 | 1 | 12 | A | $8 \times 10^{11}$ | ◎ | ◎ | 10 | O | O |
| 8 | 1 | 13 | A | $9 \times 10^{10}$ | ◎ | ◎ | 9 | O | O |
| 9 | 1 | 25 | A | $1 \times 10^{4}$ | O | O | 8.5 | O | O |
| 10 | 1 | 30 | A | $3 \times 10^{3}$ | X | O | 13 | X | X |
| 11 | 5 | 7 | D | higher than $10^{15}$ | X | X | 5 | X | X |
| 12 | 5 | 9 | C | $2.8 \times 10^{15}$ | O | O | 5 | O | O |
| 13 | 5 | 10 | B | $6 \times 10^{13}$ | ◎ | O | 4.5 | O | O |
| 14 | 5 | 11 | B | $4 \times 10^{12}$ | ◎ | ◎ | 4 | O | O |
| 15 | 5 | 12 | A | $5 \times 10^{11}$ | ◎ | ◎ | 4.5 | O | O |
| 16 | 5 | 13 | A | $6.5 \times 10^{10}$ | ◎ | ◎ | 3.5 | O | O |
| 17 | 5 | 15 | A | $3 \times 10^{9}$ | ◎ | ◎ | 4 | O | O |
| 18 | 5 | 20 | A | $6 \times 10^{6}$ | ◎ | ◎ | 3.5 | O | O |
| 19 | 5 | 25 | A | $9 \times 10^{3}$ | O | O | 15 | X | X |
| 20 | 5 | 30 | A | $1 \times 10^{3}$ | X | O | 22 | X | X |
| 21 | 15 | 5 | D | higher than $10^{15}$ | X | X | 1.5 | X | X |
| 22 | 15 | 11 | C | $9 \times 10^{11}$ | O | ◎ | 4 | O | O |
| 23 | 15 | 12 | A | $8 \times 10^{10}$ | ◎ | ◎ | 7 | O | O |
| 24 | 15 | 13 | A | $9 \times 10^{9}$ | ◎ | ◎ | 6 | O | O |
| 25 | 15 | 15 | A | $1 \times 10^{9}$ | ◎ | ◎ | 14 | X | X |
| 26 | 15 | 20 | A | $2 \times 10^{6}$ | ◎ | ◎ | 25 | X | X |

It is to be noted here that, if there is any temperature difference between contacting objects during charging through the contact, the charge polarity tends to be affected by the temperature difference, and therefore, by altering the temperature of the heating roller within the range including the temperature range normally employed, offset properties at the respective temperatures are given in FIG. 2, in which the hatched portions indicate a large degree of offset phenomenon, the laterally lined portions denote a small degree of offset phenomenon, and the white portions represent no offset phenomenon.

As is seen from the diagram of FIG. 2, upon addition of carbon fibers into the PFA resin for the offset prevention layer, offset properties are improved, but the degree of such improvement of the offset properties differ for the amounts of added carbon fibers. More specifically, as is noticed from experiments No. 2 and No. 11, offset properties are not improved even when carbon fibers are added in an amount of 7% by weight, but upon addition of carbon fibers in an amount of 9% by weight as in experiment No. 12, an improvement is noticed in the offset properties and further improvement occurs with the increase of the amount added. However, as is clear from experiments Nos. 5, 9, and 18 to 20, the offset properties tend to deteriorate as the amount of carbon fibers added becomes excessively large.

By the experiments as described above, it has been confirmed that the above deterioration of the offset properties is attributable to a reduction of the release properties of the offset prevention layer due to an increase of the amount of carbon fibers added, and that polycarbon monofluoride added for the improvement of abrasion resistance hardly contributes to the improvement of offset properties, even when the amount added is increased, and also that, as is clear from experiment No. 26, polycarbon monofluoride does not impair the release properties of the offset prevention layer even when the amount added is increased.

More specifically, the fact that the polycarbon monofluoride hardly contributes to the improvement of the offset properties even upon an increase of the amount added can be seen from the diagram of FIG. 2 as follows.

In experiments No. 4, No. 8, No. 16 and No. 24 (carbon fiber added is 13% by weight), there is almost no change in spite of an increase in the amount of polycarbon monofluoride added. Although no change is noticed in the offset properties in the experiments No. 3 and No. 6 with the addition amount of carbon fibers at 11% by weight, and offset properties for the positively charged toner and for the negatively charged toner are in the opposite relation in the experiment No. 22, in the experiment No. 14 improvement is noticed also for the negatively charged toner (paper passing time at the check point is 60 minutes respectively). When the amount of carbon fibers added is 20% by weight, results of the experiment No. 26 are slightly better than those in the experiment No. 18. However, since there is almost no change in other experiments, it may be said that polycarbon monofluoride hardly contributes to the improvement of offset properties. Accordingly, from the above findings, on the assumption that the improvement on offset properties depends only on carbon fibers, the amounts of carbon fibers added are compared, with the amount of added polycarbon monofluoride (CF)n being neglected.

In the diagram of FIG. 2, it is indicated that the larger the white portion (i.e. non-offset temperature range) is, the higher is the degree of improvement for the offset properties, with better applicability to actual use.

The relations as described above as observed from the viewpoint of actual applications are given in a column for offset property in Table 1 given earlier, in such a manner that marks O are for those with "good" results, marks ⊙ denote those having "very good" results, with a non-offset temperature range higher than 40° C., and marks X show those "not suitable for actual applications". As is seen from the column for offset property in Table 1 referred to above, the degrees of improvement of the offset properties for the positively charged toner and negatively charged toner are different in the experiments No. 3, No. 6, No. 10, No. 13, No. 20 and No. 22 depending on the amounts of carbon fibers added.

Subsequently, abrasion resistance of the heating roller was studied as follows.

With use of a Taber abrasion testing set specified in JIS (Japanese Industrial Standard) k7204, abrasion mass (mg) was obtained under the testing conditions of a load at 1 kg, and revolutions at 1500, with employment of an abrasive wheel CS-17, the results of which are shown in the column for abrasion resistance in Table 1. Simultaneously, the relation between the amounts of carbon fibers added and Taber abrasion mass related to the amounts of added polycarbon monofluoride (CF)n at 0, 1, 5 and 15% by weight was obtain, with findings as shown in FIG. 3.

Figure 3:
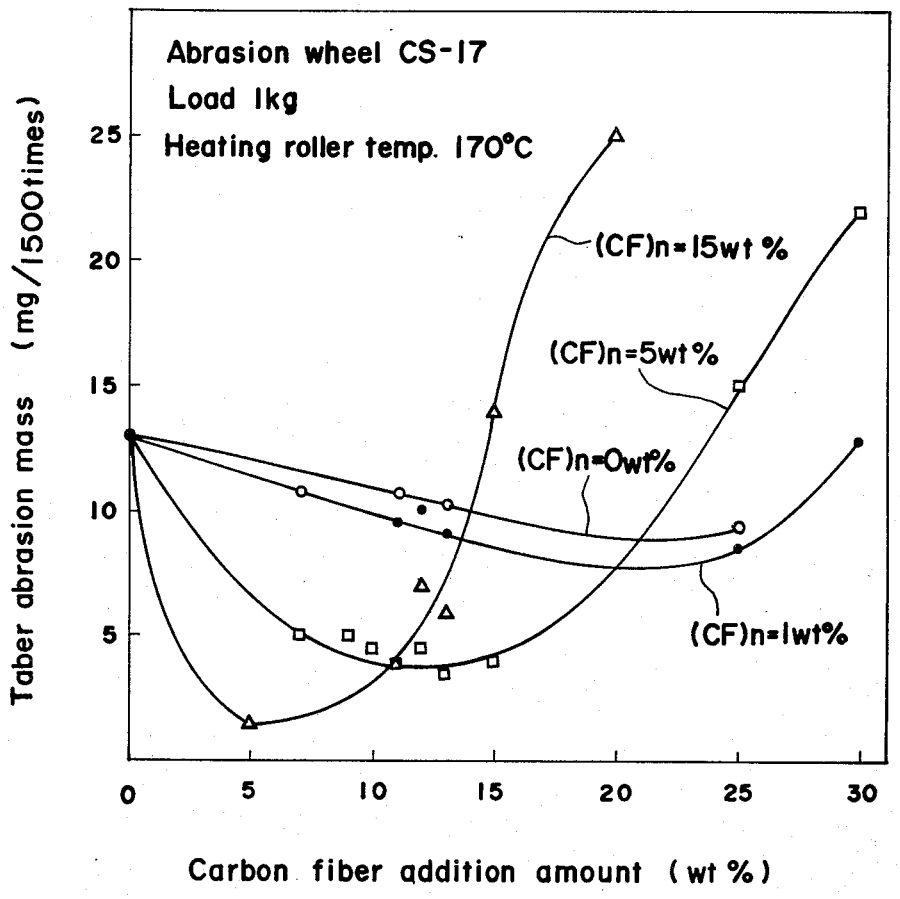
FIG. 3 is a graph showing the relation between Taber abrasion mass and amount of carbon fiber added with respect to the addition amount of polycarbon monofluoride $(CF)_n$.
Figure 4:
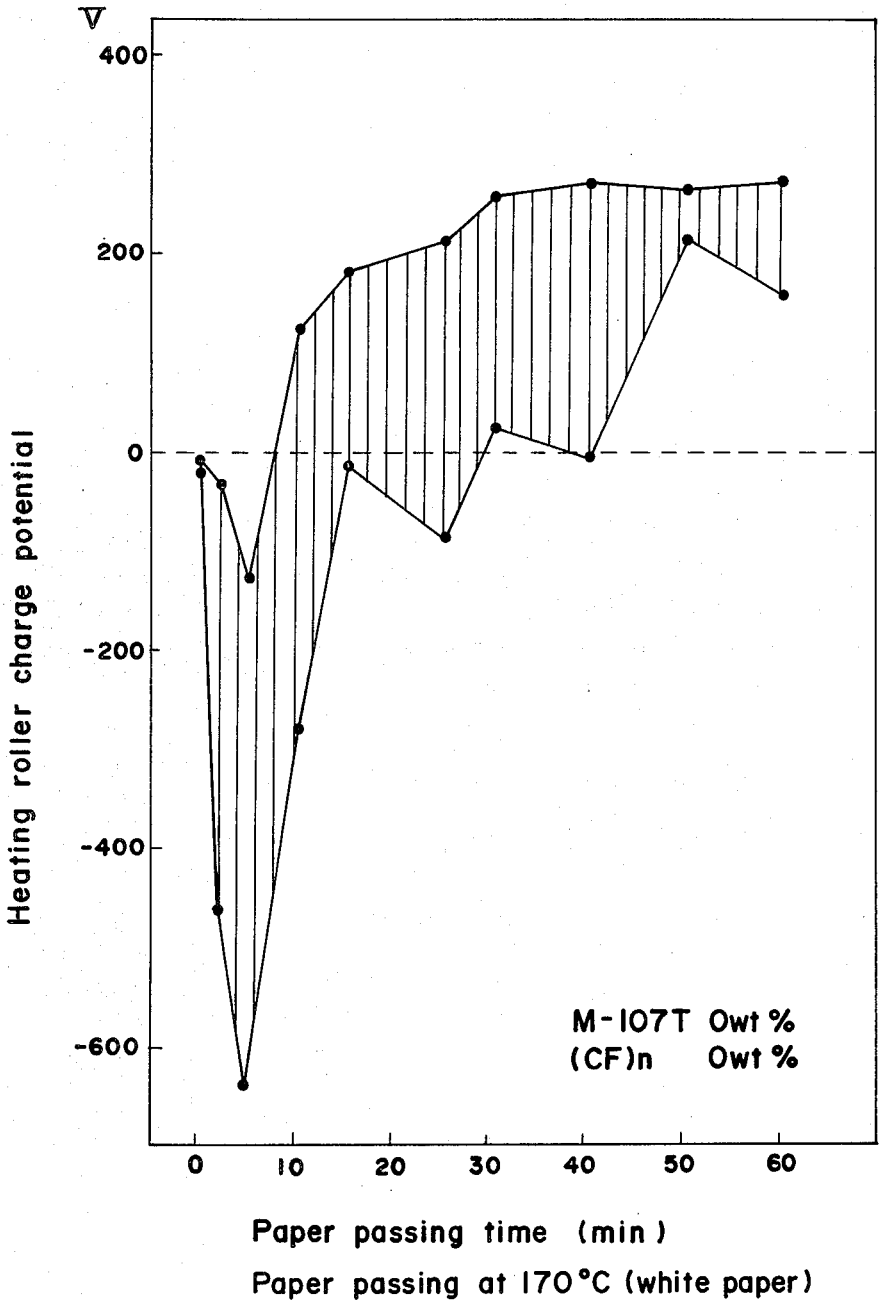
Figure 6:
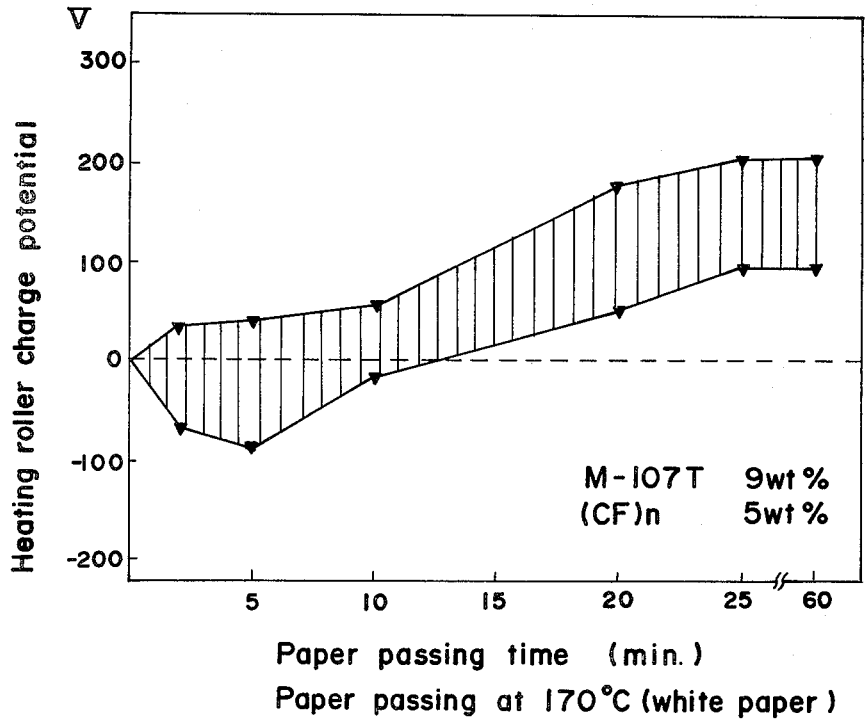
Figure 7:
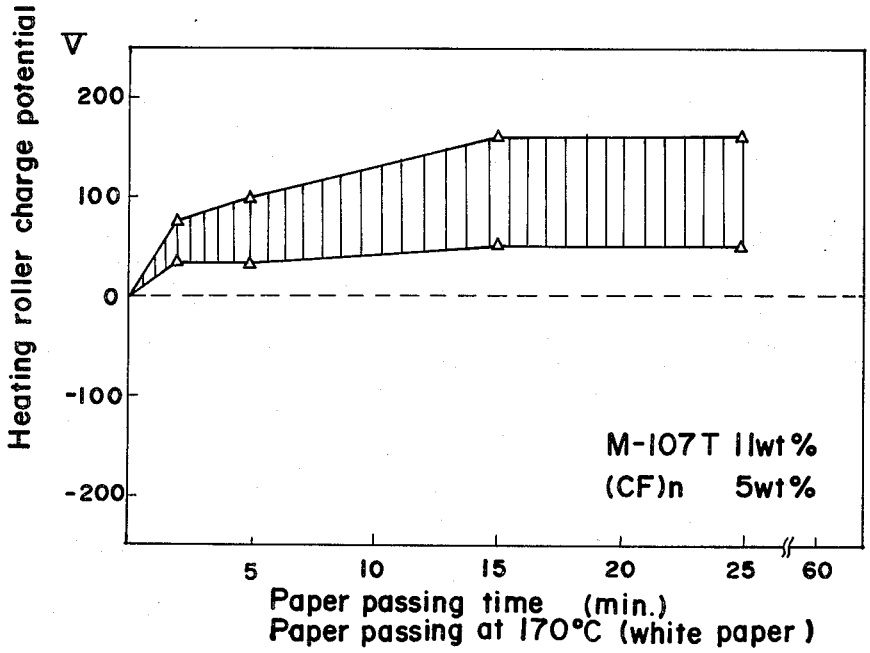
Figure 8:
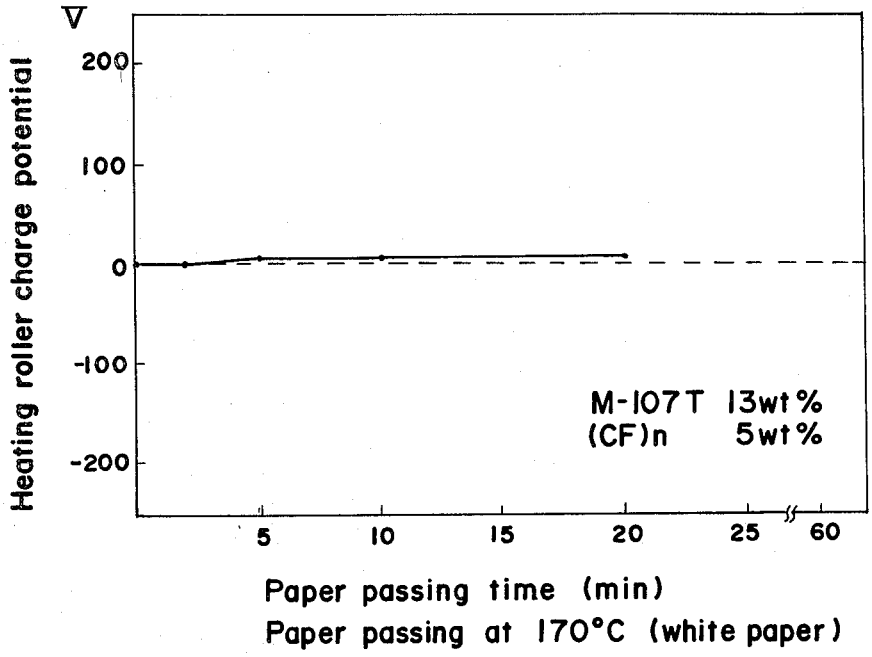
Figure 9:
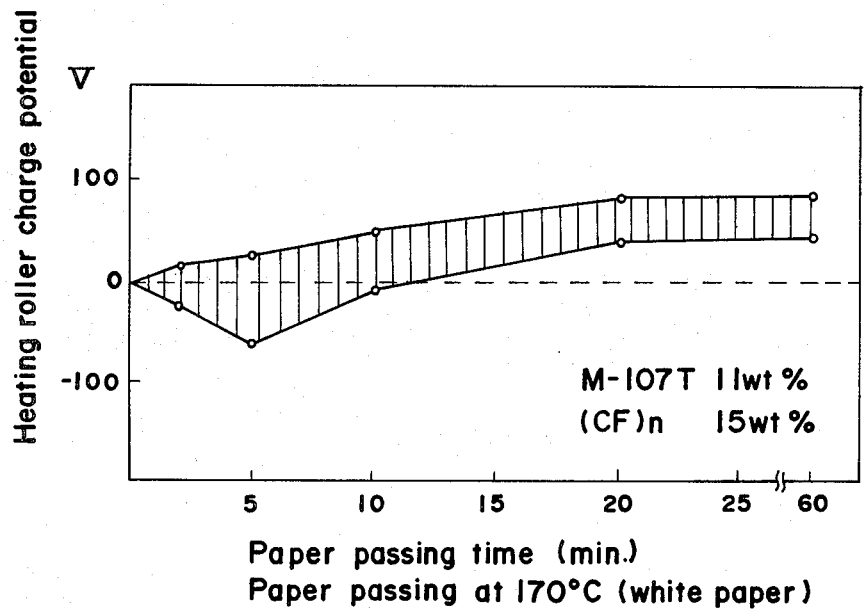

As is seen from Table 1 and FIG. 3, with the offset prevention layer only of conventional PFA resin, abrasion mass at 13 mg was produced, while the abrasion resistance was improved through addition of carbon fibers, with a marked improvement thereof upon further addition of polycarbon monofluoride. Meanwhile, from FIG. 3, it will be presumed that the curve is to be deeply shifted towards the left if the amount of added polycarbon monofluoride (CF)n is increased above 15 wt%. However, as is noticed from the experiments No. 10, No. 19, No. 20, No. 25 and No. 26 of Table 1, it was confirmed that the abrasion resistance was not improved, but on the contrary was lowered when the amount of polycarbon monofluoride plus the amount of carbon fibers exceeds 30% by weight.

In connection with the above, from the results of both experiments described so far, an overall evaluation was made on the offset properties and abrasion resistance, and results were represented in Table 1 by the marks O when both the offset properties and abrasion resistance were improved, and by marks X when either one of the offset properties or abrasion resistance was not improved.

From the above evaluation, it is seen that the offset properties and abrasion resistance become superior to the conventional offset prevention layers composed only of PFA resin when the amount of carbon fibers added is in the range of 9 to 25% by weight, and the combined amount of polycarbon monofluoride and carbon fibers is less than 30%. Furthermore, from the fact that, although it is possible to add polycarbon monofluoride (CF)n up to 20% by weight when the amount of carbon fibers is at 9% by weight, the curve for polycarbon monofluoride (CF)n at 15% by weight is superior, in the abrasion resistance, to the curve for polycarbon monofluoride (CF)n at 5% by weight only in a small range in which the amounts of carbon fibers are between above 9% by weight and below 11% by weight as is seen from FIG. 3, with the curve for polycarbon monofluoride (CF)n at 5% by weight being superior in a wide range of the carbon fiber amount of 11 to 20% by weight, and that the curve for polycarbon monofluoride (CF)n at 1% by weight is only slightly improved in abrasion resistance over the curve for (CF)n at 0% by weight, in contrast with the marked improvement of the curve for (CF)n at 5% by weight, it may be said that the amount of added polycarbon monofluoride (CF)n should desirably be approximately 5% by weight.

Moreover, by the addition of the carbon fibers and polycarbon monofluoride, heat conductivity was also improved to a large extent, with the surface temperature of the heating roller being stabilized.

Furthermore, in the case where carbon fibers in an amount of 9 to 20% by weight, and polycarbonate monofluoride in an amount of 5% by weight were respectively added to the PFA resin, i.e. in the case where abrasion mass was less than 5 mg, sufficient abrasion resistance was achieved even when the thickness of the offset prevention layer of the heating roller in the present mebodiment was reduced to about 15 to 20$\mu$, with a further improvement in the heat conductivity.

Subsequently, in order to study the relation between the improvement of offset properties and charging characteristics of the heating roller, white copy paper sheets of A4 size were passed between the heating roller and the pressure roller held under pressure of 40 Kg at a rate of 12 sheets per minute and at a speed of 11 cm/sec., with the temperature of the heating roller set at 170° C., and the maximum and minimum surface potentials on the circumference of the heating roller during the above time were measured by a vibration type surface potentiometer, the results of which are shown in the graphs of FIG. 4 through FIG. 9, with respect to the experiments Nos. 1, 11, 12, 14, 16 and 22. As is clear from these graphs, the charging characteristics thereof are broadly divided into curves A, B, C and D as shown in the graph of FIG. 10.

Figure 10:
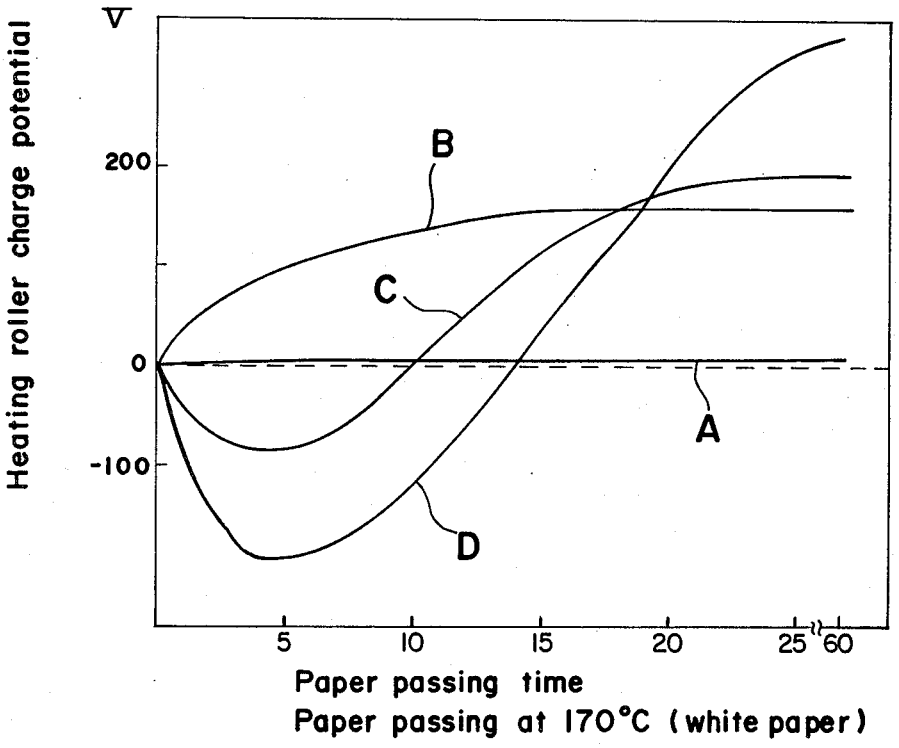

More specifically, in FIG. 10, the curve A represents a case where the heating roller is hardly charged or is not charged at all, the curve B shows a case where the heating roller is positively charged from an initial stage, with the surface potential thereof being less than 200 V, the curve C relates to a case where the charging polarity varies from negative to positive according to the paper passing time, with the surface potential being in the range between −100 V and +200 V and the curve D shows a case where the relation is the same as in the curve C, but with a large variation as compared with the curve C.

The charging characteristics based on the above results of measurements are shown in a column for characteristics in Table 1, with the curves A, B C and D being represented by corresponding symbols A, B, C and D.

As is clear from the results of the foregoing experiments it has been ensured that, by addition of carbon fibers to the PFA resin, triboelectric charging of the heating roller is suppressed, and thus, the electrostatic attraction of the positively or negatively charged toner does not take place, with a consequent improvement in the offset properties.

In the foregoing experiments, although the surface potential of the heating roller was suppressed to the range of −100 V to +200 V, with the improvement of the offset properties when the amount of carbon fibers added exceeds 9% by weight, it is necessary to take into account the fact that the above surface potential varies with the pressure roller to be employed, the material of the copy paper sheets, variations of the surrounding conditions, especially, humidity, etc., and also that the range of the offset phenomenon also varies with variations in the amount of charge according to the kinds of toner employed.

Attention should be directed here to the facts that, as is seen from the experiments Nos. 7, 15, and 23, the heating roller is hardly charged or not charged at all as shown by the charging characteristics of the curve A when the amount of carbon fibers added exceeds 12% by weight, and in this case, the offset phenomenon of the positively and negatively charged toners may be prevented, without being affected by the various conditions as described above.

Accordingly, to set the amount of carbon fibers added above 12% by weight may be said to be most preferable for a heating roller in a fixing device of a copying apparatus employing both positively charged and negatively charged toners from the aspect of actual application also.

Incidentally, as shown in the experiments Nos. 10 and 20, when the amount of carbon fibers added exceeds 25% by weight, release properties are reduced as described earlier, with deterioration of the offset properties, although the heating roller is not charged. Therefore, the offset phenomenon of the positively charged and negatively charged toners is prevented without being affected by the above condition when the carbon fibers are added in an amount of 12 to 25% by weight. Meanwhile, the total amount of polycarbon monofluoride and carbon fibers added is required to be less than 30% by weight (from experiments Nos. 19 and 25) and more preferably less than 28% by weight (from experiment No. 24).

Subsequently, for examining the relation between the improvement in the offset properties and electrical resistance of the heating roller, volume resistivities of offset prevention layers laminated on aluminum plates each 10 cm square were measured with the use of an electrical resistance tester (Ultra high megohm meter manufactured by TAKEDA RIKEN Co., Ltd. Japan), the results of which measurements are given in a column for electric resistance of Table 1.

By the results of the above experiments, it has been ensured that the electrical resistance of the heating roller is lowered as the amount of carbon fibers added to the PFA resin is increased, and that when the electric resistance is larger than $10^{15}$ Ω·cm. offset phenomenon tends to take place, and in the range of $10^{13}$ to $10^{16}$ Ω·cm, the offset properties are improved, with favorable offset properties at an electrical resistance below $10^{12}$ Ω·cm, particularly, in the range between below $10^{11}$ Ω·cm and above $10^{6}$ Ω·cm.

EXAMPLE 2

Experiments were carried out under the same conditions as in EXAMPLE 1 except that, as the carbon fibers to be added to the PFA resin, PYROFIL NR7003 (name used in trade and manufactured by Mitsubishi Rayon Co., Ltd. Japan) (diameters 7 to 8μ, fibers at a fiber length of 6 mm and ground to have a fiber length shorter than 1 mm), was employed for addition and mixing (experiments Nos. 27 to 30) at the rates as shown in a composition column of Table 2 given below. The results of the experiments for the offset properties are shown in FIG. 11, while those for the abrasion resistance, charging characteristics and electrical resistance etc., are respectively given in Table 2.

Although the above experiments relate only to an amount of added polycarbon monofluoride of 5% by weight, it has been confirmed that, in a similar manner as in EXAMPLE 1, the offset properties and abrasion resistance are improved approximately to the same extent with a similar tendency also with respect to the triboelectric charging and electric resistance of the heating roller.

TABLE 2

| Experiment No. | PFA additive: CFn add. amount (wt %) | PFA additive: PYROFIL NR 7003 add. amount (wt %) | charging characteristics | Electrical resistance (Ω · cm) | Offset property: + toner | Offset property: − toner | Abrasion mass (mg/1500 times) | Overall evaluation: + toner | Overall evaluation: − toner |
|---|---|---|---|---|---|---|---|---|---|
| 27 | 5 | 9 | C | $4 \times 10^{15}$ | O | O | 4 | O | O |
| 28 | 5 | 11 | B | $1 \times 10^{12}$ | ◎ | ◎ | 4.5 | O | O |
| 29 | 5 | 13 | A | $1 \times 10^{10}$ | ◎ | ◎ | 4 | O | O |
| 30 | 5 | 25 | A | $7 \times 10^{3}$ | O | O | 13 | X | X |
| Comp. data: carbon black 25 wt % | | | A | $9 \times 10^{10}$ | O | O | 11.5 | O | O |

Comparative data

Experiments were carried out in a similar manner as in EXAMPLE 1 except that the carbon fibers and polycarbon monofluoride to be added to the PFA resin were replaced by only carbon black MA-8 (name used in trade and manufactured by Mitsubishi Chemical Industries Co., Ltd. Japan) alone, in an amount of 25% by weight, which is the maximum amount which can be added to the offset prevention layer for the improvement of the offset properties.

The results of the above comparative experiments for the offset properties are also shown in FIG. 11, while those for the abrasion resistance, charging characteristics, and electric resistance are represented in Table 2.

From the above experiments, it is seen that, although the offset properties and abrasion resistance may be improved, an amount thereof of 25% by weight is required therefor, and the offset properties can not be improved any further in relation to the release properties.

As is clear from the foregoing description, according to the present invention, by causing fluorine resin which forms the offset prevention layer of the heating roller to contain carbon fibers in the range between 9 to 25% by weight, not only the offset phenoemenon of images formed by positively charged or negatively charged toner is prevented, but abrasion resistance and heat conductivity of the heating roller can be improved and further, by causing said fluorine resin to contain polycarbon monofluoride and polycarbon fibers in an amount less than 30% by weight or more preferably less than 28% by weight, abrasion resistance can be further improved, and by reduction of the thickness of the offset prevention layer of the heating roller, heat conductivity can also improved, with a consequent reduction in cost for the heating roller itself.

Furthermore, by causing fluorine resin to contain carbon fibers in an amount of 12 to 20% by weight, offset phenonmenon for either of the positively charged or negatively charged toner image can be advantageously prevented, without being affected by various conditions such as the pressure rollers employed, material of the copy paper sheets, surrounding conditions, and amount of charge on the toner, etc.

Another advantage according to the present invention is such that since no offset prevention solution is required, simplification and cost reduction of the fixing device may be achieved.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A heat roller fixing device for use in an electrophotographic copying apparatus and the like, which comprises a heating roller constituted by an offset prevention layer laminated on an electrically conductive core member and having heating means incorporated therein so as to be driven for rotation by driving means, and a pressure roller constituted by an electrically insulative layer on another electrically conductive core member and held in contact under pressure with the heating roller for simultaneous rotation with said heating roller, thereby to fix a toner image formed on the copy paper onto the copy paper by causing said copy paper carrying said toner image thereon to pass between said heating roller and said pressure roller, said offset prevention layer being composed of fluorine resin containing carbon fibers in a predetermined amount.

2. A heat roller fixing device as claimed in claim 1, wherein said fluorine resin of the offset prevention layer of said heating roller contains an amount of carbon fibers in the range of 9 to 25% by weight.

3. A heat roller fixing device as claimed in claim 1, wherein said fluorine resin of the offset prevention layer of said heating roller contains an amount of carbon fibers in the range of 12 to 20% by weight.

4. A heat roller fixing device as claimed in claim 1, wherein said heating means is capable of heating said heating roller up to temperatures in the range of 140° to 210° C. during operation of the heat roller fixing device, according to the kinds of toner employed.

5. A heat roller fixing device as claimed in claim 1 in which said fluorine resin of the offset prevention layer of said heating roller further contains, in addition to the carbon fibers, polycarbon monofluoride.

6. A heat roller fixing device as claimed in claim 5 in which the combined amount of polycarbon monofluoride and the carbon fibers is less than 30% by weight.

7. A heat roller fixing device as claimed in claim 6 in which the combined amount of the polycarbon monofluoride and the carbon fibers is less than 28% by weight.

* * * * *